US012577706B2

(12) United States Patent
Haslinger et al.

(10) Patent No.: US 12,577,706 B2
(45) Date of Patent: Mar. 17, 2026

(54) LYOCELL FIBERS AND METHODS OF PRODUCING THE SAME

(71) Applicant: Aalto University Foundation sr, Aalto (FI)

(72) Inventors: Simone Haslinger, Espoo (FI); Yingfeng Wang, Aalto (FI); Eugenia Smirnova, Vantaa (FI); Michael Hummel, Aalto (FI); Herbert Sixta, Aalto (FI); Marja Rissanen, Aalto (FI)

(73) Assignee: Aalto University Foundation sr, Aalto (FI)

( * ) Notice: Subject to any disclaimer, the term of this patent is extended or adjusted under 35 U.S.C. 154(b) by 289 days.

(21) Appl. No.: 17/761,240

(22) PCT Filed: Sep. 17, 2020

(86) PCT No.: PCT/FI2020/050600
§ 371 (c)(1),
(2) Date: Mar. 17, 2022

(87) PCT Pub. No.: WO2021/053272
PCT Pub. Date: Mar. 25, 2021

(65) Prior Publication Data

US 2022/0380941 A1 Dec. 1, 2022

(30) Foreign Application Priority Data

Sep. 17, 2019 (FI) ..... 20195776

(51) Int. Cl.
*D01F 2/06* (2006.01)
*D01F 1/06* (2006.01)
(Continued)

(52) U.S. Cl.
CPC ..... *D01F 2/06* (2013.01); *D01F 1/06* (2013.01); *D01F 13/02* (2013.01); *D06P 1/38* (2013.01)

(58) Field of Classification Search
None
See application file for complete search history.

(56) References Cited

U.S. PATENT DOCUMENTS

2013/0267140 A1* 10/2013 Gstettner ..... D02G 3/047 428/221
2016/0053407 A1 2/2016 Michud et al.

FOREIGN PATENT DOCUMENTS

CN 103388188 A 11/2013
CN 105392929 A 3/2016
(Continued)

OTHER PUBLICATIONS

Machine translation of EP3511447 (Year: 2019).*
(Continued)

*Primary Examiner* — Shawn Mckinnon
(74) *Attorney, Agent, or Firm* — Laine IP Oy; Mark W. Scott

(57) ABSTRACT

Colored lyocell type fibers comprising respun coloured recycled fibers and method of producing the same. According to the method a raw-material of colored recycled textile fibers is provided and dissolved in an ionic liquid to provide a spinning dope. By spinning the dope using dry jet-wet spinning colored respun textile fibers can be manufactured. The invention provides for the simultaneous recycling of cellulose fibers and dyes from dyed cotton waste in the form of dyed lyocell fibers.

13 Claims, 8 Drawing Sheets

(51) Int. Cl.
*D01F 13/02* (2006.01)
*D06P 1/38* (2006.01)

(56) References Cited

FOREIGN PATENT DOCUMENTS

| | | | | |
|---|---|---|---|---|
| CN | 110080010 | A | | 8/2019 |
| CN | 110214205 | A | | 9/2019 |
| EP | 3511447 | A1 | | 7/2019 |
| WO | WO2018142025 | | * | 8/2018 |

OTHER PUBLICATIONS

Bui et al. ("CI Reactive Black 5 dye as a visible crosslinker to improve physical properties of lyocell fabrics", Cellulose (2009) 16:27-35.) (Year: 2009).*
Niinimaki et al. (Colours in a Circular Economy, Circular Transitions Proceedings, Aalto University, 2017). (Year: 2017).*
Bjorquist et al. ("Textile Qualities of Regenerated Cellulose Fibers from Cotton Waste Pulp", Textile Research Journal, vol. 88, iss, 21, Jul. 28, 2017). (Year: 2017).*
Avinash et al. ("Spun-Dyed Lyocell", Dyes and Pigments, vol. 7, iss. 3, 2007, pp. 519-524.) (Year: 2007).*
Sixta et al: Ioncell-F: A High-strength regenerated cellulose fibre. Nordic Pulp & Paper Research Journal, Jan. 2015, vol. 30, No. 1, pp. 43-57.
Björquist: Separation for regeneration. Chemical recycling of cotton and polyester textiles. The Swedish School of Textiles—Thesis, Jun. 4, 2017, Report No. 2017.14.04, pp. 1-59.
Kostag et al: Recent Advances in Solvents for the Dissolution, Shaping and Derivatization of Cellulose: Quaternary Ammonium Electrolytes and their Solutions in Water and Molecular Solvents. Molecules, Feb. 25, 2018, vol. 23, No. 511, 38 Pages.
Michud et al: Ioncell-F: ionic liquid-based cellulosic textile fibers as an alternative to viscose and Lyocell. Textile Research Journal, Jun. 16, 2015, vol. 86, No. 5, pp. 543-552.
Haslinger et al: Recycling of vat and reactive dyed textile waste to new colored man-made cellulose fibers. Green Chemistry, 2019, vol. 21, pp. 5598-5610.

* cited by examiner

LYOCELL FIBERS AND METHODS OF PRODUCING THE SAME

FIELD OF THE INVENTION

The present invention relates to regenerated fibers and methods of methods of manufacturing the same. In particular the present invention relates to colored lyocell type fibers and to methods of producing the same from cellulosic raw-material.

BACKGROUND

The world's population is expected to exceed 8 billion by 2025. With an increase of the population, the global demand for limited resources has grown accordingly. Textiles are one of those resources. In 2017, the world produced a total amount of 103 million tons of fibers; of which man-made fibers accounted for 69% (72 million tons).

At the same time, textile waste has increased significantly because of the continued consumption of textile products. Studies show that the textile and apparel industries are the second largest source of pollution on the planet after the oil and mining industries. The natural resources consumed by the textile industry are mainly materials and energy used for farming, processing, manufacturing, and transportation.

Today, most post-consumer textiles are ultimately disposed of in landfills; therefore, it is necessary to develop an effective textile recycling technology to achieve a more sustainable development of the textile industry.

If recycled and converted to new fibers or yarns, colored textile waste needs to be bleached before it is further processed and respun. After recycling, the new fibers and yarns are re-dyed. This creates an additional waste stream resulting from pretreatment chemicals and dyes The dyeing process is very important for the sale of textile products, but the dyeing of textiles has a big impact on the environment. The use of synthetic dyes consumes large amounts of chemicals, water, and energy, and emits large amounts of sewage and air pollutants. More than 50% of the production of colorants (about 1 million tons per year) are used in textile dyeing in the world. In developed countries, the dyeing and printing of one ton of fiber consumes 100 tons of water, while, in other parts of the world, it can increase to 300 or even 400 tons. Usually, wastewater discharged from the dyeing process contains relevant dyes, dispersants, mordants and surfactants (usually "unspecified" compounds present in commercial dyes), and most plants discharge untreated wastewater directly into local rivers, which negatively affects the environment.

Some of the compounds that are not readily biodegradable, such as color brighteners, softeners, and sizing agents, have a direct impact on human health and on the environment. Non-aromatic dyes often carry harmful heavy metals and therefore require a variety of toxic finishing processes.

As an alternative to the traditional wet dyeing technology, spun-dyeing provides not only excellent fiber quality, but also dyes evenly and reduces the environmental impact. In addition, it has its own unique advantages, such as bright color and luster, and excellent color fastness. Spun-dyed fibers have been shown to cause a lower environmental impact in all LCA categories than traditional dyed fabrics, including acidification, eutrophication, and ozone depletion. Moreover, with the increasing scarcity of water resources, the treatment of dye waste water is subject to stricter environmental control. The spinning and dyeing technology reduces water consumption where the fiber can be dyed with very little water.

Spun-dyed fibers are dyed during the spinning process by either dyeing the pulp, or the spinning dope.

The most critical consideration in the dyeing process is whether the polymer colorant mixture has physical and chemical stability. Especially for the dyeing of regenerated cellulose, a strong reducing agent and/or an oxidizing agent usually used in the treatment of these celluloses impairs the stability of the coloring agent.

Regarding their chemical nature, dyes can be divided into different classes such as vat dyes and reactive dyes. Vat dyes are a class of dyes that are classified as such because of the method by which they are applied. Vat dyeing is a process that refers to dyeing that takes place in a bucket or vat. The original vat dye is indigo, once obtained only from plants but now often produced synthetically. Vat dyes, which are suitable for cellulosic fiber fabrics, are resistant to light, have good washing fastness, and are resistant to chlorine bleaching and other oxidative bleaching. For example, an anthraquinone dye has been dispersed in a spinning dope as a pigment to form a recycled substrate the matrix formed is treated with a reagent to reduce the vat dye in the fiber.

In all of these techniques, reduction of the vat dye to its parent form is typically accomplished by treating the matrix with a reducing agent. However, vat dyes have some limitations because they tend to prematurely oxidize, which tends to result in uneven distribution of the dye in the spinning dope. Reactive dyes are the most used in cellulosic fiber fabrics. They are characterized by having bright color, are resistant to light, can withstand water washing and have good rubbing fastness.

At present, reactive dyes account for about 30% of global synthetic dyes. In a reactive dye, a chromophore (an atom or group whose presence is responsible for the colour of a compound) contains a substituent that reacts with the substrate. Reactive dyes have good fastness properties owing to the covalent bonding that occurs during dyeing. Reactive dyes are most commonly used in dyeing of cellulose like cotton or flax, but also wool is dyeable with reactive dyes. Reactive dyeing is the most important method for the coloration of cellulosic fibres. Reactive dyes have a low utilization degree compared to other types of dyestuff, since the functional group also bonds to water, creating hydrolysis. Reactive dyes have various chemical structures, such as azo, anthraquinone, phthalocyanine, methylazine, triazine and oxazine. Most reactive dyes are highly soluble and do not degrade in water.

[DBNH][OAc], a superbase based ionic liquid, enables the conversion of waste material from various sources such as cardboard, newsprint, and uncolored post-consumer cotton to new lyocell type fibers.

Due to their high thermal and chemical stability, ionic liquids have also been proposed as "green solvents" for various applications.

SUMMARY OF THE INVENTION

It is an aim of the present invention to provide novel regenerated cellulosic fibers, in particular from recycled cellulosic raw-material.

It is another aim of the present invention to provide a method of producing colored regenerated fibers, in particular lyocell fibers.

It is a third aim of the present invention to provide a novel method of recycling dyes, such as dyes used for coloring of fibrous matter.

The present invention is based on the finding that ionic liquids are suitable for the use in the recycling of colored textile waste, in particular of cellulosic textile waste.

The method of producing colored lyocell type fibers, typically comprises the steps of

- providing a raw-material of colored recycled textile fibers;
- dissolving the feedstock in an ionic liquid to provide a spinning dope, and
- spinning the dope by using dry jet-wet spinning into colored textile fibers.

The invention further provides for the simultaneous recycling of cellulose fibers and dyes from dyed cellulosic waste, such as cotton or flax waste, in the form of dyed lyocell fibers.

More specifically, the present invention is mainly characterized by what is stated in the characterizing portions of the independent claims.

Considerable advantages are obtained by the present invention. As will appear, the ionic liquids will have an enhancing effect in textile dyeing and can be readily applied in dry jet wet spinning processes, thus allowing for the use in the recycling of colored textile waste.

Compared to conventional dyeing procedures, the spun fibers show a better color fastness and a more even distribution of the dye within the fiber matrix. This enhances the durability and optical properties The process will facilitate the valorization of textile waste by the creation of a circular economy, and the reduction of the carbon footprint.

The present fibers are high performance fibers with excellent tensile strength

At the same time, the present invention will reduce waste pollution caused by textile waste, as well as to lower the environmental pollution caused by textile dyeing industry. Thus, the present invention provides for simultaneous recycling of cellulose fibers and dyes from dyed cotton waste in the form of dyed lyocell fibers.

Thus, in one aspect, the present invention provides for recycling of dyes used for dyeing of cotton by dissolution of fibrous cotton matter containing said dye into an organic liquid capable of dissolving the fibrous matter and the dye to form a dope and using the dope to make new colored fibers (regenerated fibers) by spinning.

Next, embodiments will be studied in more detail with the reference to the appended drawings.

EMBODIMENTS

Figure 1A:
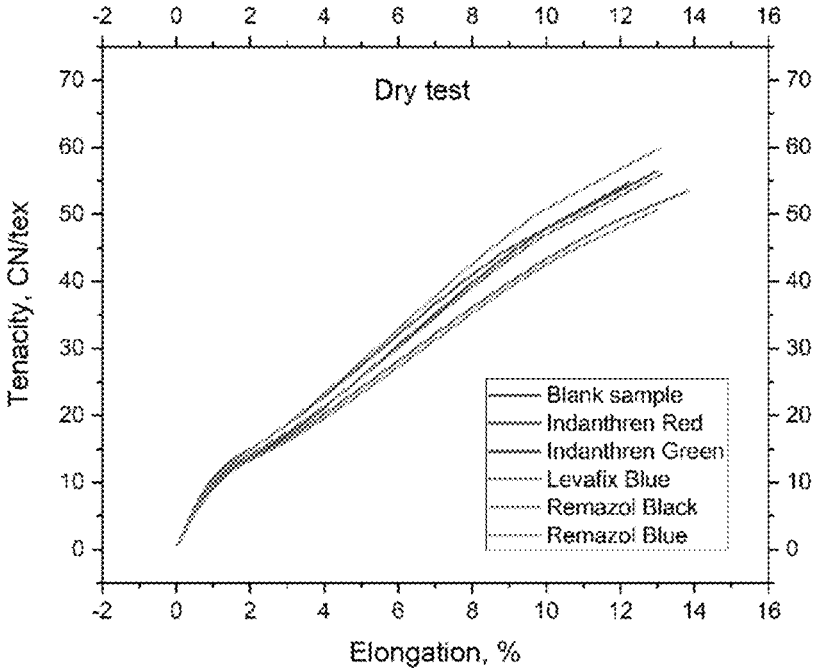
FIGS. 1A and 1B are graphical depictions showing the stress-strain curves of spun fibers in terms of tenacity as a function of elongation, FIG. 1A in dry testing and FIG. 1B in wet testing.

In the present context, "lyocell type fibers" and "lyocell fibers" are used synonymously. The terms stand for fibers composed of cellulose precipitated (i.e. regenerated) from an organic solution in which no substitution of the hydroxyl groups takes place and no chemical intermediates are formed.

In one particular embodiment, the present lyocell fibers are produced by dissolving the cellulose raw-material in an ionic liquid, such as an ionic liquid of the superbase type.

Superbases that can form the basis for superbase-based ionic liquids include, e.g. 1,5-diazabicyclo[4.3.0]non-5-ene (DBN), 7-methyl-1,5,7-triazabicyclo[4.4.0]dec-5-ene (MTBD), 1,8-diazabicyclo[5.4.0]undec-7-ene (DBU), N,N,N,N,NN-hexamethylphosphorimide triamide (HMPI), N,N,N,N-tetramethylguanidinium (TMG), and 1,2-dimethyl-1,1,4,5,6-tetrahydropyrimidine (DMP). Superbase-based ionic liquids are suitable ionic liquids in some embodiments. Ionic liquids used in embodiments are typically in the form of acid-superbase conjugates, in particular acetates such as DBUH OAC, preferably DBNH OAc, suitably mTBDH OAc are suitable ionic liquids in further embodiments As a particular example of a superbase-based ionic liquid DBNH OAc may be mentioned. It is employed as a new generation ionic liquid in the Ioncell-F process (Sixta et al. 2014). It is able to selectively dissolve the cellulosic component, such as cotton.

In one embodiment, the present textiles comprise respun, colored lyocell type fibers. In particular, the present fibers comprise colored lyocell type fibers comprising recycled colored fibers.

In one embodiment, the fibers comprise dry jet wet spun fibers. The "dry jet wet spinning", refers to a combination of both wet and dry spinning techniques for fiber formation. Typically, in the dry-jet-wet spinning process, high orientation is accomplished.

The novel fibers contain dye typically in a concentration of about 0.1 to 5%, for example up to 2%, by weight of the dry fibrous matter.

In one embodiment, the fibers are colored by using a colorant having a chemical structures of the azo, anthraquinone, phthalocyanine, methylazine, triazine or oxazine type.

As examples of dyes the following can be mentioned: vat dyes, in particular an Indanthren dye, or reactive dye, such as a Remazol and Levafix dye and combinations thereof.

In one particular embodiment, the dye is selected from the group of Indanthren Br Green, Indanthren Red, Levafix BrRed E-4BA, Levafix Blue E-GRN, Remazol Black 133% and Remazol Br Blue and combinations thereof.

In one embodiment, the dye is selected from the group of Indanthren Br Green, Indanthren Red, Levafix Blue E-GRN, Remazol Black 133% and Remazol Br Blue and combinations thereof. As will appear from the examples discussed below, the mechanical properties of the fibers are after spinning good.

In one embodiment, the fibers are spun from a dope comprising an ionic liquid, in particular a superbase-based ionic liquid, such as [DBNH][OAc] or [MTBDH][OAc], [DBNH][OAc] being particularly preferred.

One embodiment for producing the present novel regenerated fibers, more specifically colored lyocell type fibers, comprises generally the steps of

- providing a raw-material of colored recycled textile fibers;
- dissolving the raw-material in an ionic liquid to provide a spinning dope, and
- spinning the dope by using dry jet-wet spinning into colored textile fibers.

The raw-material typically comprises recycled cellulosic or cellulose rich textile fibers, in particular cotton fibers, such as cotton fiber waste or cotton fiber rich waste. Also other suitable cellulosic fibers, such as flax, can be used as raw-material.

The raw-material typically comprises at least 50 wt-%, preferably at least 60 wt-%, for example 75 to 100 wt-% of cellulosic fibers, such as cotton fibers. The raw-material can also contain other textile fibers, such as polyester and viscose, such as rayon, fibers. Thus, in one embodiment, the raw-material comprises colored textile fibers formed by blends of cotton and one or more of polyester, viscose and lyocell fibers and mixtures thereof.

In one embodiment, the raw-material comprises pre-consumer or post-consumer textile waste, in particular post-consumer textile waste. The textile waste can comprise materials in the form of yearn, thread, cloths, sheaths, clothes, linen and sheaths and other articles comprising fibrous matter.

One embodiment comprises the steps of

- providing a colored recycled cellulose or cellulose rich textile fibers,
- sorting the textile fibers according to color to form a feedstock having a preselected color, and
- dissolving the first feedstock in an ionic liquid to form a spinning dope.

The spinning dope is typically subjected to dry jet-wet spinning to form textile fibers having a color generally corresponding to the preselected color.

In one embodiment, the regenerated fibers are spun using a spinneret (200 holes with 0.1 mm diameter).

As will appear from the below experimental data, the color of the recycled fibers will generally be preserved during the processing, although some fading may take place. Thus, the expression corresponding to a preselected color is to be understood to stand for a color of the respun fibers which is basically the same as that of the raw-material fiber but in which the intensity of the color can be somewhat lessened.

In one embodiment, which can be combined with any of the above embodiments, the textile waste to be respun has a viscosity of about 450 ml/g.

In one embodiment, if the viscosity of the raw-material is higher than the about 450 ml/g, its viscosity can be adjusted to the desired range by hydrolysis, mechanical or chemical degradation, or mild (non-bleaching) pretreatment.

Before dissolution, the textile waste is typically subjected to mechanical processing, for example by grinding, and then dissolved in an ionic liquid, particularly [DBNH][OAc], and dry jet wet spun to new, colored fibers.

The colored fibers exhibit properties that are superior to those of the starting material.

In the experiments discussed below, two different dye classes, among them vat and reactive dyes, were tested on white cotton waste fabrics, with the aim of recovering them bound to fibers produced by dry jet wet spinning using [DBNH][OAc].

White postconsumer cotton waste was dyed with typical representative dyes (i.e. Indanthren Red FBB coll, & BrGreenFBB coll, Remazol BRBlue spec. and Black B and Blue E-GRN gran), ground, and subsequently dissolved to obtain the respectively colored spinning dopes. The spinning yielded high-tenacity fibers comparable to Lyocell, which all showed a good color fastness except Remazol Black B.

As will appear from the examples, it is possible to translate dyes of different classes from waste fabric to new regenerated fibers, in particular fibers of the lyocell type. This also partly indicates that the chemical structure of the dyes remain unchanged during the dry-jet wet spinning.

A comparison of the mechanical properties of the spun fibers, shows that the mechanical properties of the dyed fibers after spinning are almost the same as those of the reference (Blank sample). And some dyed fibers have even better mechanical strength than the blank sample.

As the experimental evidence shows, by means of the present invention, the process of respinning dyed cotton waste garments is completely feasible.

EXPERIMENTALS

Raw-material. The raw material was hospital bed sheets from the Uusimaa Hospital Laundry (Uudenmaan Sairaalapesula Oy, Finland). The bed sheets were heterogeneous and consisted of white cotton with gray parts. In this research, the gray parts were removed and only the pure white parts were used. They were clean and without any treatment before use.

Dyeing procedures. Below are the six dyes tested:

1. Indanthren Red FBB coll,
2. Indanthren BrGreen FBB coll,
3. Levafix BrRed E-4BA,
4. Levafix Blue E-GRN gran,
5. Remazol BrBlue R spec and
6. Remazol Black B gran 133%.

Among these, Indanthren dyes are vat dyes, while Remazol and Levafix are reactive dyes. Remazol BrBlue R spec and Remazol Black B gran 133% were provided by the A. Wenström company; the others were supplied by DyStar.

The chemical structures of these dyes are as follows:

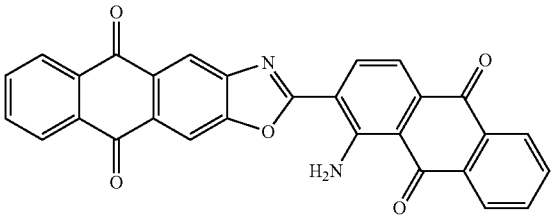

Indanthren Red FBB coll

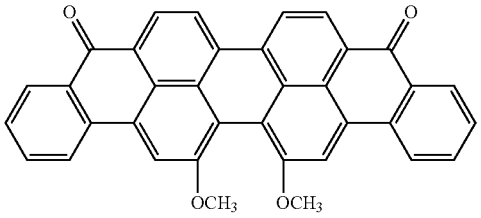

Indanthren Brilliant Green FBB coll

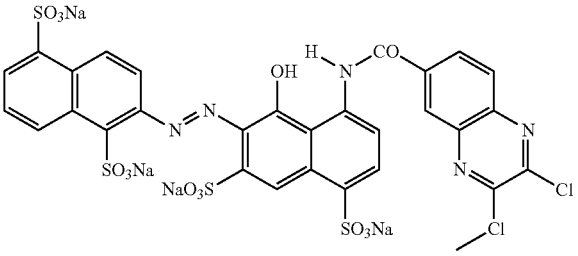

Levafix Brillian Red E-4BA

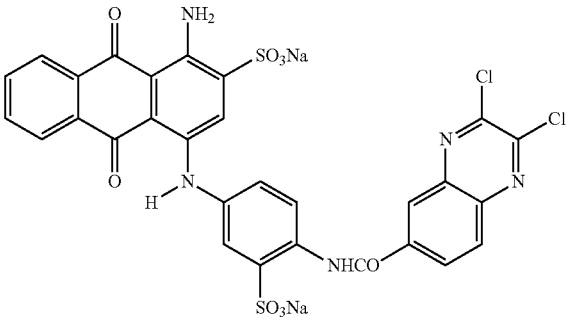

Levafiz Blue E-GRN gran

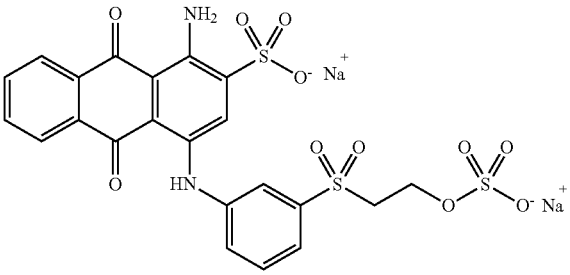

Remazol Brilliant Blue R spec

-continued

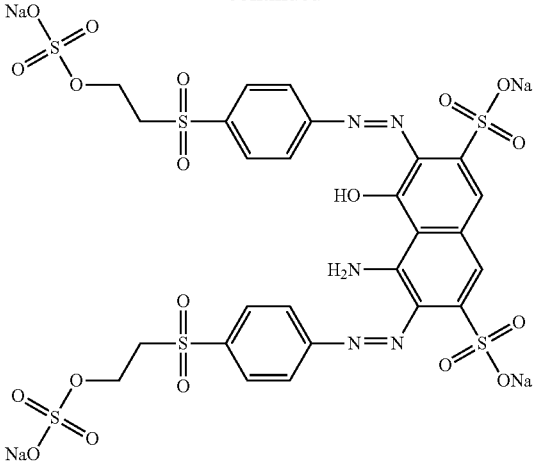

Remazol Black B gran 133%

The amount of fabric for each dye was around 1000 g. For vat dyes, the fabric was stirred with the dyes in a big pot (25 L). In this procedure, hydrosulfite ($Na_2S_2O_4$), sodium hydroxide (NaOH) and glauber salt ($Na_2SO_4 \cdot 10H_2O$) was added 20 L of water.

$Na_2SO_4 \cdot 10H_2O$ and NaOH reduced the dyes and made the dyes water-soluble. In doing so, $Na_2S_2O_4$ increased the affinity of the dyes to the fabric and made the dyes react better. The amount of each dye was 2% of the dry mass of the fabric, and the amount of $Na_2S_2O_4$, NaOH and $Na_2SO_4 \cdot 10H_2O$ was 3 g/L, 3 mL/L and 12 g/L, respectively (the total with water was 20 L). First, 20 L of water heated to 50° C. and was maintained at this temperature during the whole process (45 min), and then the dyes were added once the water reached 50° C., as well as the $Na_2S_2O_4$, NaOH, fabric and $Na_2SO_4 \cdot 10H_2O$. The dyes' color changed after adding these chemicals as the chemical reaction occurs. When stirring the fabrics at 50° C. for 45 min, they need to be under the water in order to prevent oxidation of the dyes.

The fabric was washed with a $H_2O_2$ solution (2 mL/L) after dyeing, until the water was clean. The role of $H_2O_2$ was to increase the oxidation of the dyes and to make the dyes water insoluble. Therefore, these dyes can be permanently retained on the fabric. It also protected the fabric from fading during subsequent washings. Finally, the fabrics were dried and preserved for a later use.

For reactive dyes, we used a Esteri washing machine (Esteri Pesukoneet Oy, Vantaa, Finland) for dyeing, where the "60° C., 20 L" program was selected. Glauber salt ($Na_2SO_4 \cdot 10H_2O$) and soda ash ($Na_2CO_3$) was used in this procedure. As shown above, the $Na_2SO_4 \cdot 10H_2O$ facilitated the reaction of dyes with the fabric and the $Na_2CO_3$ provided an alkaline environment. The amount of dye was also 2% of the dry mass of the fabric, and the amount of $Na_2SO_4 \cdot 10H_2O$ and $Na_2CO_3$ was 50 g/L and 9 g/L, respectively (the total with water was 20 L). The sample to liquor ratio was 1:20 and the temperature was 60° C. The reaction sequence in the dyeing machine was the following: prewetting+gentle spin-dyeing-rinsing-boiling-rinsing-spin. The program goes through all these steps and the duration of the dyeing was dependent on the liquor ratio and the dyeing temperature (around 3 h). When dyeing was complete, the fabrics were air-dried.

[DBNH][OAc]. [DBN][OAc] was synthetized by neutralizing 1,5-diazabicyclo [4.3.0] non-5-ene, DBN, (99%, Fluorochem, UK) with acetic acid (glacial, 100%, Merck, Germany). The acetic acid was slowly added to DBN to avoid a fast raise of temperature from 30° C. to 60° C. within a short time. Subsequently, the temperature was kept at 75° C. for 1 h under constant stirring.

Dope preparation. The dyed fabrics were ground into powders, and then the cellulose was dissolved in [DBNH][OAc] using a vertical kneader system. The concentration of the dope was 13% of OVD cotton. The required kneading time for samples was 1.5 h at 80° C. After dissolution, dope was filtrated by press filtration (1-2 MPa, metal filter fleece, 5-6 um absolute fineness, Gebr. Kufferath AG, Germany) at a temperature of 80° C. Afterwards, the dope was shaped into a mold and put it in a refrigerator until it solidified.

Dry-jet wet spinning. The spinning process was conducted with a dry jet wet spinning unit KS80 (Fourne Polymertechnik, Germany). The solution was melted according to its rheological properties, extruded through a spinneret (200 holes, 0.1 mm diameter), and stretched (draw ratio of 12) in a 1 cm air gap between the spinneret and the water bath. The resulting fibers were collected from a metal roller and cut into staple fibers (4 cm). Afterwards, they were opened, washed at 80° C. for 2 h, and dried at room temperature.

Spin finishing. There were two chemicals that were used in this spin finishing process: Afilan CVS (lubricant, CNP1016998, Archroma) and Leomin PN (antistatic, DEH8003044, Archroma). The amount of spin finishing on the fibers was 0.25% of the dry mass of the fibers. Among this, Afilan CVS accounted for 80% and the Leomin PN for 20%. The sample to liquor ratio was 1:20. Firstly, the water was heated to 50° C., and then Afilan CVS and Leomin PN were added, respectively. The fibers were added after the chemicals were completely dissolved and were stirred slowly in solution for 5 min at 50° C.

Fiber opening. The fibers were opened after spin finishing by using a fiber opener (Trash analyser, 281C, Mesdan, Italy).

Yarn spinning. The first step of the yarn spinning was fiber carding. This process arranges all of the fibers to go into the same direction. Then, the fibers were put into a drafting machine two times in order to wrap the fibers together. In the first occurrence, the carded fibers were aligned to a fiber bundle, then the fiber bundle was put into the drafting machine again, wrapped around a bobbin far yarn spinning. In the yarn spinning process, the fiber bobbin hung in a high position and the yarn could collect during ring spinning in the bottom of the spinning machine. The spinning parameters, like the twist (700 m), total draft (40) and spinning speed (10000 rpm) changed according to the properties of the fibers in the control window.

Limiting Viscosity. The viscosity of each bedsheet used in this experiment was determined according to the SCAN-CM 15:88 standard in cupri-ethylenediamine (CED) solution.

Rheology. The rheology of the spinning dope was carried out by using an Anton Paar PHYSICA MCR 300 Rheometer. In total, seven samples were measured under the same measurement conditions with a Peltier temperature control system and dynamic frequency scanning (gap size 1 mm, plate diameter 25 mm). The dope was subjected to a dynamic frequency sweep at an angular frequency of 0.1-100 $s^{-1}$ to determine the storage modulus G' and loss modulus G" in a temperature range of 60-100° C. Then the crossover point of G' and G" would be calculated by using Rheoplus software.

CIELab. The samples before and after spinning, as well as before and after washing were measured on a CIE10° C. observer with standard illuminant D65 using a CIELAB machine (SpectroScan, GretagMacbeth).

Washing Fastness. The color fastness of the dyed fabric and the spun fibers were tested in this experiment before and after washing. Each fabric was put in an iron bucket with 10 small steel balls (6 mm), and a low-sudsing detergent (AATCC 1993 Standard Reference Detergent). It was washed and shaken in a washing machine for half an hour, taken out and rinsed with 100 ml of water and finally dried in an oven. The color change and staining on the colorless test fabric was evaluated according to the standard methods of EN ISO 105-006.

Tensile Testing. The elongation at break (%), tenacity (cN/dtex) and linear density (dtex) of all spun fibers were measured by a textile-testing device (Textechno Favigraph, Germany) (b-c). The experimental parameters were as follows: the load cell was 20 cN; gauge length was 10 mm (the spun fiber was a bit short in this experiment, so the gauge length was changed from 40 mm to 10 mm); the test speed was 10 mm/min; pretension weight was 100 mg; and the number of tests for each sample was 20. Each sample had a conditioned test (23° C., 65% relative humidity) and a wet test. The elastic modulus and proportionality limit was calculated through Matlab software.

SEM. The fiber cross sections were prepared by cryofracture, and were subsequently sputter-coated with gold to enhance their electrical conductivity (30 mA, 1 min). After the sample preparation was complete, a Zeiss Sigma VP SEM was used to take images with 1.5 kV operating voltage.

Raw-Material

The below table shows the material's viscosity before the experiment. The number of the sample represents the order of test in the experiment. Each number represents a batch (around 200 g).

TABLE 1

The viscosity of the raw-material

| Sample | Viscosity/ml/g |
|---|---|
| 1 | 533 |
| 2 | 371 |
| 3 | 412 |
| 4 | 409 |
| 5 | 460 |
| 6 | 572 |
| 7 | 496 |
| 8 | 444 |
| 9 | 896 |
| 10 | 453 |
| 11 | 302 |
| 12 | 437 |
| 13 | 375 |
| 14 | 372 |
| 15 | 467 |
| 16 | 329 |
| 17 | 602 |
| 18 | 330 |
| 19 | 496 |
| 20 | 1247 |
| 21 | 1056 |
| 22 | 1006 |
| 23 | 422 |
| 24 | 387 |
| 25 | 401 |
| 26 | 379 |
| 27 | 534 |
| 28 | 438 |
| 29 | 307 |
| 30 | 523 |
| 31 | 457 |
| 32 | 333 |

TABLE 1-continued

| The viscosity of the raw-material | |
|---|---|
| Sample | Viscosity/ml/g |
| 33 | 386 |
| 34 | 359 |
| 35 | 1269 |
| 36 | 620 |
| 37 | 460 |
| 38 | 634 |
| 39 | 1459 |
| 40 | 427 |
| 41 | 1047 |
| 42 | 397 |
| 43 | 544 |
| 44 | 582 |
| 45 | 1219 |
| 46 | 1068 |
| 47 | 518 |
| 48 | 407 |
| 49 | 369 |
| 50 | 413 |

As will appear, Table 1 shows that the viscosity of each batch is different (varying in the range from 302 ml/g to 1459 ml/g), while the viscosity of the spinnable fiber is around 450 ml/g, so only 30 batches in the table meet the requirements of use (369 ml/g to 544 ml/g).

Among these, Blank sample (33,48), Indanthren Red FBB coll (43, 47, 49, 50), Indanthren BrGreen FBB coll (31, 37, 40, 42), Remazol BrBlue R spec (1, 2, 3, 13, 23), Remazol Black B gran 133% (4, 5, 14, 15, 27), and Levafix Blue E-GRN gran (24, 25, 26, 28, 30) were chosen.

The average viscosity of the selected cotton fibers as shown in Table 2.

TABLE 2

| The average viscosity of the selected cotton fibers | |
|---|---|
| Sample | Average Viscosity/ml/g |
| Blank sample | 397 |
| Indanthren Red | 461 |
| Indanthren BrGreen | 435 |
| Remazol BrBlue | 423 |

TABLE 2-continued

| The average viscosity of the selected cotton fibers | |
|---|---|
| Sample | Average Viscosity/ml/g |
| Remazol Black | 448 |
| Levafix Blue | 426 |

Spinnability of the dyed waste fabrics. Table 3 shows the rheology data for 7 samples (6 dyed dopes+1 Blank sample) at 80° C.

In the table, η0*(Pa·s) is zero shear viscosity, ω (1/s) refers to the angular frequency and it is equivalent to the shear rate of a small strain oscillation motion, G (Pa) refers to shear modulus. The cross over point is determined by the storage modulus (G') and loss modulus (G"). Normally, the viscosity range of spinnable dope is 2000 Pa·s-30000 Pa·s. From these data, we can generally infer the spinnablity of the dope and adjust the temperature range for the spinning machine. In other words, obtaining the Rheology data of the spinning dope is a necessary condition.

In this experiment, through the data of Table 3, the temperature control system of the spinning machine was effectively set.

The polymer concentration in each sample was 13 wt % and the 6 samples (5 dyed dopes+1 Blank sample) were successfully spun.

TABLE 3

| Rheology results | | | |
|---|---|---|---|
| Samples | η0* (Pa · s) | ω (1/s) | G (Pa) |
| Blank sample | 15655 | 1.46 | 4883 |
| Indanthren Br Green | 60126 | 0.27 | 4031 |
| Indanthren Red | 13573 | 2393 | 5497 |
| Levafix Blue E-GRN | 14105 | 1.94 | 5819 |
| Remazol Black 133% | 27903 | 1.06 | 5109 |
| Remazol Br Blue | 25241 | 0.39 | 2980 |

Tensile properties of the spun fibers. The draw ratio for all samples was 12.

Table 4A shows the tensile testing results in dry conditions.

TABLE 4A

| The tensile data in dry conditions | | | | | | | | |
|---|---|---|---|---|---|---|---|---|
| Dry_test | Linear density | Elastic modulus | Strain | Stress | Modulus of toughness | | Modulus of resilience | |
| Samples | dtex | GPa | % | MPa | MPa | J/g | MPa | J/g |
| Blank | 1.24 | 12.43334917 | 1.96785 | 176.314 | 64.17174 | 42.78116 | 1.419375 | 0.94625 |
| sample | | 2.534919298 | 0.51513 | 11.17779 | 11.08735 | 7.391564 | 0.29184 | 0.19456 |
| Indanthren | 1.33 | 14.39921399 | 1.62703 | 183.5931 | 60.01962 | 40.01308 | 1.320538 | 0.880359 |
| Br Green | | 2.323700462 | 0.40869 | 14.42534 | 13.93456 | 9.289704 | 0.33472 | 0.223146 |
| Indanthren | 1.37 | 12.53328118 | 1.60059 | 171.917 | 69.4622 | 46.30813 | 1.295622 | 0.863748 |
| Red | | 2.216394346 | 0.37991 | 23.98809 | 12.97457 | 8.649711 | 0.224853 | 0.149902 |
| Levafix | 1.24 | 13.16827977 | 1.82543 | 177.9035 | 64.75684 | 43.17123 | 1.373136 | 0.915424 |
| Blue E-GRN | | 2.510877172 | 0.56117 | 17.41316 | 14.12984 | 9.419891 | 0.396614 | 0.26441 |
| Remazol | 1.40 | 12.04813364 | 1.77186 | 176.287 | 59.55298 | 39.70198 | 1.476363 | 0.984242 |
| Black B 133% | | 2.152013367 | 0.47199 | 23.23758 | 13.27728 | 8.851521 | 0.425469 | 0.283646 |
| Remazol | 1.17 | 13.16550582 | 2.09775 | 190.2048 | 69.53976 | 46.35984 | 1.560045 | 1.04003 |
| Br Blue | | 2.471845898 | 0.43545 | 8.908182 | 12.98079 | 8.653862 | 0.338489 | 0.22566 |

Table 4B shows the tensile testing results in wet environment.

TABLE 4B

The tensile data in wet environment

| Dry_test | Linear density | Elastic modulus | Strain | Stress | Modulus of toughness | | Modulus of resilience | |
|---|---|---|---|---|---|---|---|---|
| Samples | dtex | GPa | % | MPa | MPa | J/g | MPa | J/g |
| Blank | 1.23 | 7.690459158 | 10.3799 | 625.0313 | 60.58602 | 40.39068 | 32.1111 | 21.4074 |
| sample | | 0.689649274 | 2.43404 | 110.2598 | 9.593251 | 6.395501 | 13.65439 | 9.102926 |
| Indanthren | 1.28 | 7.289490672 | 11.7986 | 686.4687 | 55.58703 | 37.05802 | 40.97753 | 27.31835 |
| Br Green | | 0.657274646 | 2.159 | 110.2492 | 13.03486 | 8.689909 | 14.76213 | 9.841417 |
| Indanthren | 1.29 | 7.271602509 | 12.1143 | 710.0568 | 64.91292 | 43.27528 | 44.81728 | 29.87819 |
| Red | | 0.347075145 | 2.29408 | 101.7981 | 7.963557 | 5.309038 | 15.67566 | 10.45044 |
| Levafix | 1.23 | 7.490003121 | 11.7163 | 707.7061 | 62.54432 | 41.69621 | 40.84077 | 27.22718 |
| Blue E-GRN | | 0.544713439 | 1.60121 | 62.14959 | 12.64155 | 8.427697 | 9.77698 | 6.517987 |
| Remazol | 1.30 | 7.025200434 | 12.48 | 688.987 | 59.92978 | 39.95319 | 43.96477 | 29.30984 |
| Black B 133% | | 0.55241631 | 2.04067 | 98.61595 | 9.388327 | 6.258885 | 13.81567 | 9.210444 |
| Remazol | 1.15 | 7.700505369 | 11.8666 | 695.4712 | 72.47478 | 48.31652 | 42.15441 | 28.10294 |
| Br Blue | | 1.279583446 | 3.26948 | 130.8965 | 13.13218 | 8.754789 | 20.70374 | 13.80249 |

The fiber elastic modulus also called "initial modulus" is the force required to stretch to an additional 1% of its original length. The size of the fiber elastic modulus indicates how easy it is to deform the fiber under a small load. It reflects the rigidity of the fiber and is closely related to the properties of the fabric. When other conditions are the same, as the elastic modulus of the fiber becomes larger, the more difficult it is to deform. This means that the shape of the fabric during use changes less.

From the comparison of Tables 4A and 4B, it can be seen that the dyed fibers have a larger elastic modulus under dried conditions than in a wet environment, which indicates that the dyed fibers are relatively sturdy under dry conditions and easily deformed in water.

For dyed fibers under dry conditions, the elastic modulus is between 12.05 and 14.40 GPa, where the elastic modulus of Indanthren Green fiber is the largest, indicating that the fabric obtained from this fiber is relatively stiff and not easily deformed. The elastic modulus of Remazol Black 133% is 12.05. In terms of texture, it should be softer. The elastic modulus of the dyed fibers in a wet environment is between 7.03 and 7.70. Unlike dry conditions, Remazol Br Blue fiber (7.70) is not easily deformed in water, while Remazol Black 133% fiber (7.03) is the softest in water.

Figure 1B:
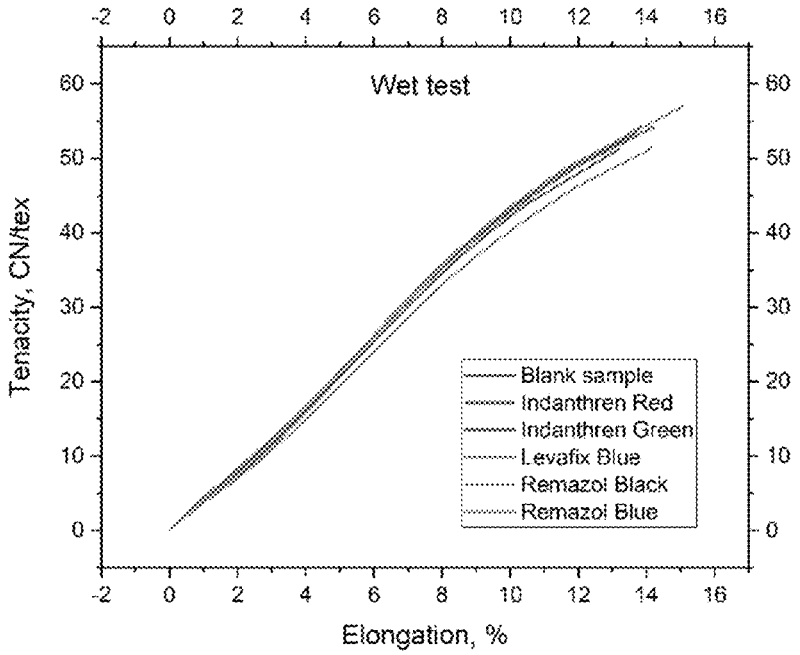

FIGS. 1A and 1B shows the stress-strain curves of the spun fibers. Based on these two graphs, Remazol Blue spun fiber has the strongest tenacity and Remazol Black spun fiber has the weakest tenacity in these two conditions. However, the difference among these 6 spun fibers in the dry test is a bit bigger than in the wet test.

Figure 2:
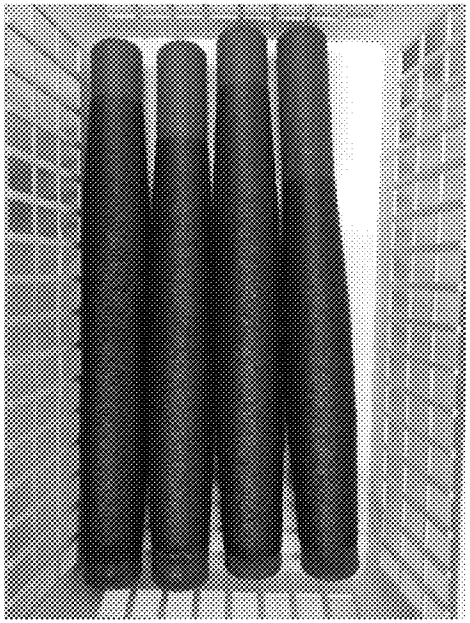
FIG. 2 is a photograph showing the products of yarn spinning.

Tensile properties of yarn. One sample (Indanthren Br Green fiber) was processed to yarn (cf. FIG. 2). The yield of yarn for Indanthren Br Green fiber is 89.64% and the whole process went very smoothly. After yarn spinning, the properties of the yarn obtained were tested in the dry conditions.

The results are shown in Table 5.

TABLE 5

Tenacity test of yarn

| Specimen # | Tex (g/1000 m) | Peak force (N) | Breaking force (cN) | Conditioned Breaking elongation (mm) | Conditioned Elongation at break (%) | Conditioned Tenacity (cN/tex) |
|---|---|---|---|---|---|---|
| AVG | 20.78 | 6.00 | 600.01 | 16.01 | 6.40 | 28.87 |
| ST. DEV. | 0.38 | 0.75 | 75.39 | 1.25 | 0.50 | 3.63 |
| CV % | 1.82 | 12.57 | 12.57 | 7.78 | 7.78 | 12.57 |

Tenacity test of yarn, and the average data of tenacity, peak force, breaking force, elongation and tenacity can be seen in first line of the table.

Figure 3:
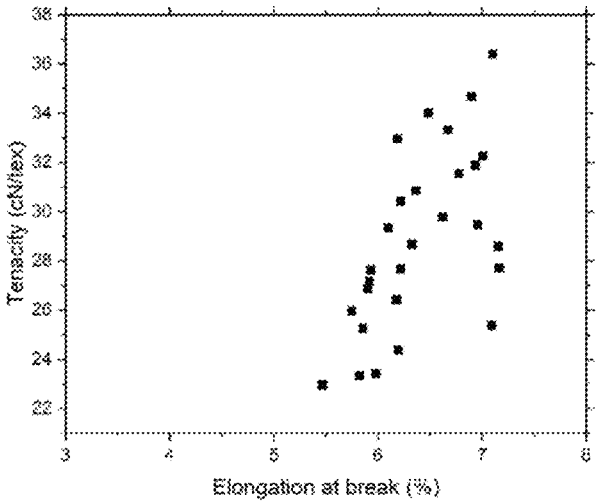
FIG. 3 shows the correlation between elongation and tenacity.

Regarding the "Elongation at break (%)" and "Tenacity" correlation images FIG. 3, it can be seen from that the correlation between them is very high, which indicates that the yarn obtained has good quality.

Color difference. CIELab is a color system of CIE; it is used to determine the numerical information of a certain color. The Lab values represent the brightness, red-greenness, and yellow-green color of one color, respectively. The larger L value, the brighter the color. When a>0, the color tends toward red, and the larger the a value, the more red the color. When a<0, it means that the color tends toward green. b>0 goes towards yellow, while b<0 goes towards cyan. The color difference of L, a, b between two samples can also be represented by a single color difference symbol, ΔE, which is the total color difference between the samples. The larger the value of ΔE, the larger the color difference.

$$E=\sqrt[1]{\Delta L^2+\Delta a^2+\Delta b^2} \quad (1)$$

$$\text{Where } \Delta L=L_0-L_1;\Delta a=a_0-a_1;\Delta b=b_0-b_1 \quad (2)$$

Figure 4A:
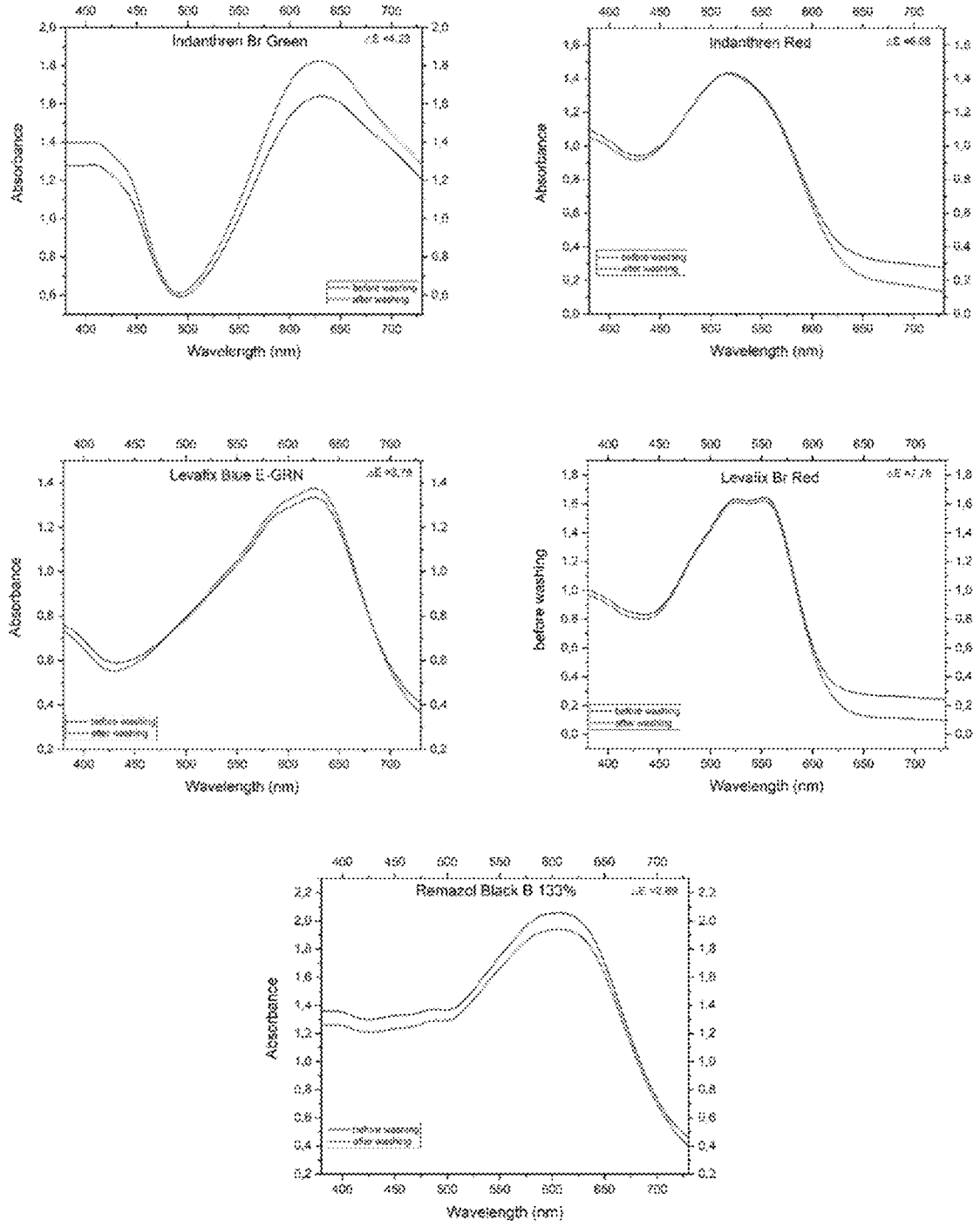
FIG. 4A is a graphical depiction of the color change of dyed fabric (before and after washing) in terms of absorbance as a function of wavelength.
Figure 4B:
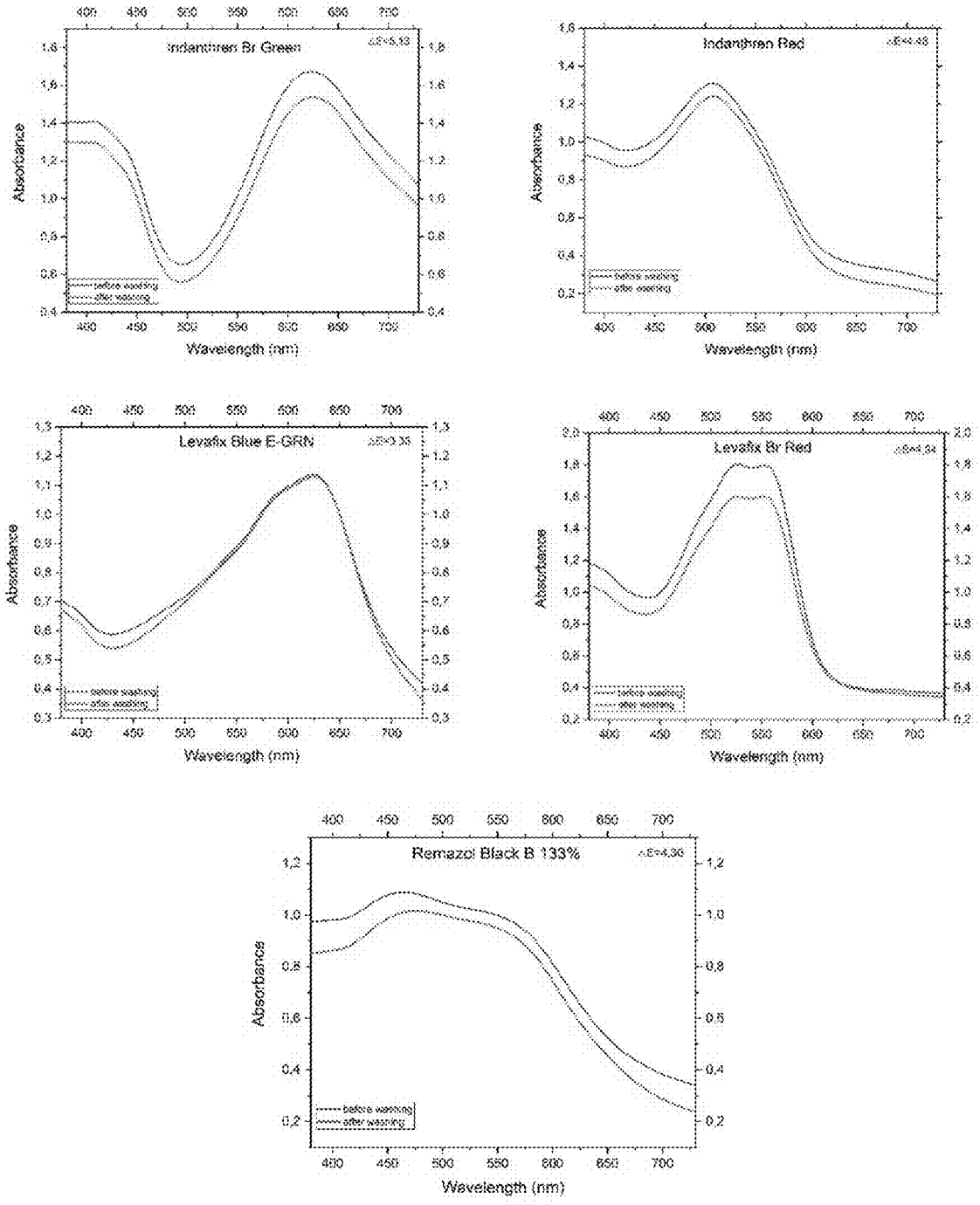
FIG. 4B is a graphical depiction of the color change of spun fiber (before and after washing) in terms of absorbance as a function of wavelength.
Figure 4C:
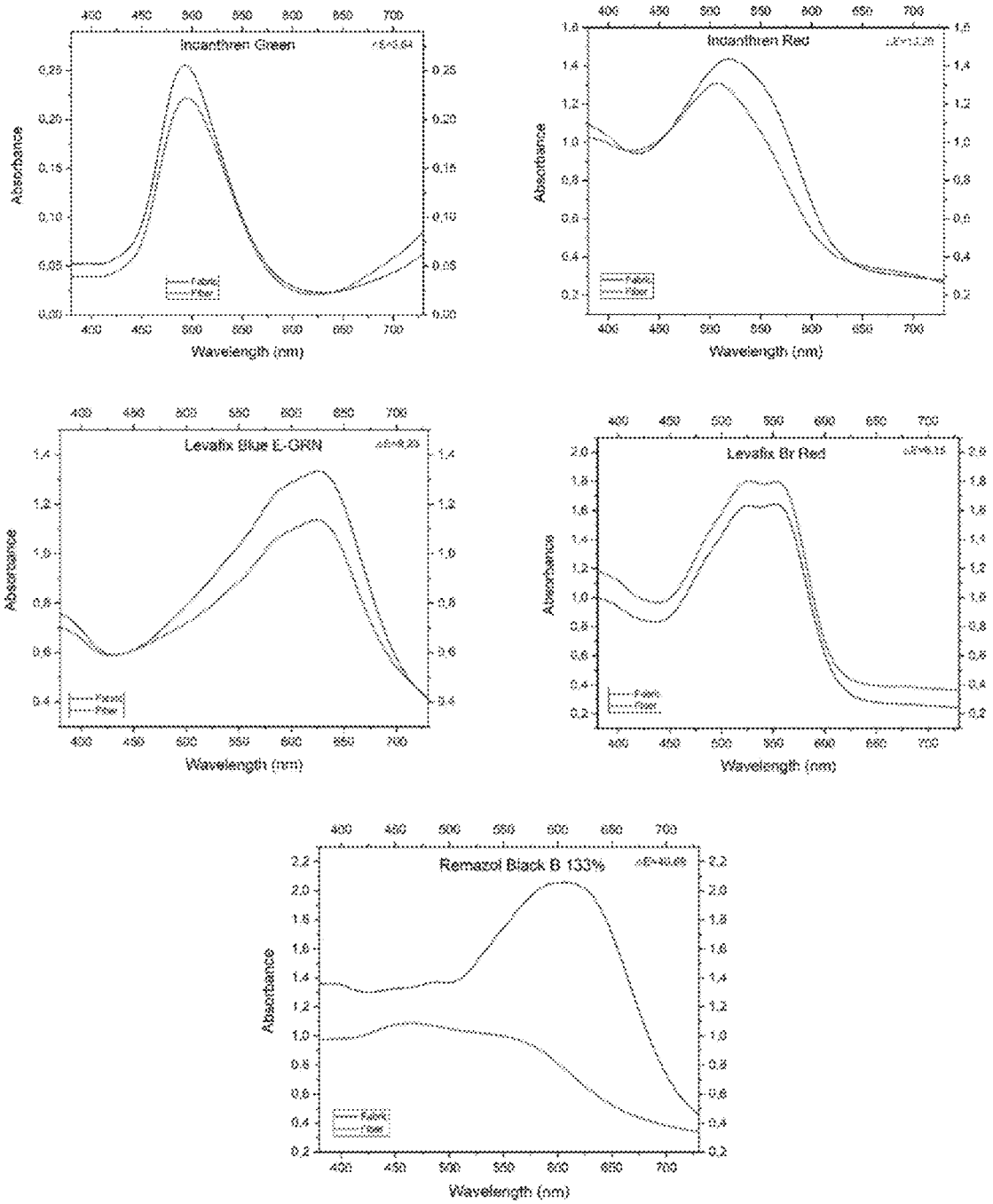
FIG. 4C is a graphical depiction of the color change between dyed fabric and spun fiber (before and after spinning) in terms of absorbance as a function of wavelength.

FIGS. 4A to 4C show the curves of color change of dyed fabrics and spun fibers.

It can be seen that each two curves of every sample fit very well, except the Remazol Black sample between dyed fabric and spun fiber. It means that its color changed a lot from dyed fabric to spun fiber through dry-jet wet spinning.

Figure 5:
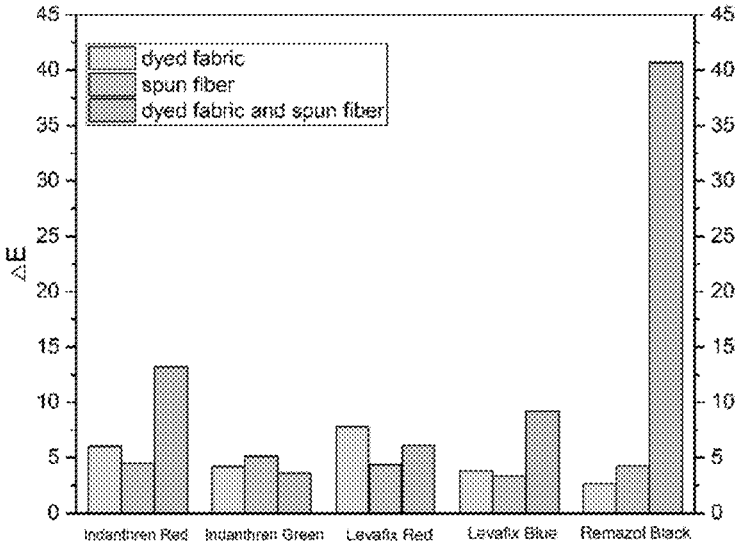
FIG. 5 is a bar chart showing the color change of three groups

FIG. 5 shows a comparison of all ΔE values of the three respective comparisons.

It can be concluded that for the dyed fabric, the biggest change in color during washing is the Levafix Br Red fabric (ΔE=7, 79), and the biggest color change of the spun fiber before and after washing is Indanthren Br. Green (ΔE=5, 13). For the spinning process, Remazol Black B 133% has the largest color change (ΔE=40, 69).

Color fastness properties. This experiment tests the washing color fastness of the fibers. The sample is sewn together with standard lining fabric, and under goes a washing and drying process under suitable temperature, alkalinity, bleaching and rubbing conditions. The friction used was achieved by tumbling and impacting 10 stainless steel beads in order to get test results in a short period of time. Finally, the samples were dried and rated with a gray card.

The ratings were: Level 1, Level 1-2, Level 2, Level 2-3, Level 3, Level 3-4, Level 4, Level 4-5, Level 5. Level 1 is the worst, level 5 is the best (no fading).

Tables 6A and 6B show the rubbing and washing fastness of the dyed fabric.

TABLE 6A

| Color fastness of dyed fabric | | | | | | |
|---|---|---|---|---|---|---|
| | color stay | | | | | |
| Dyed fabric Samples | color change | cotton | polyamide | polyester | acrylic | wool |
| Indanthren Br Green | 5 | 4 | 4 | 4.5 | 4 | 4.5 |
| Indanthren Red | 5 | 4.5 | 4.5 | 5 | 5 | 5 |
| Levafix Blue E-GRN | 5 | 5 | 5 | 5 | 5 | 5 |
| Levafix Br Red | 5 | 4.5 | 4.5 | 4.5 | 4.5 | 5 |
| Remazol Black B 133% | 5 | 5 | 5 | 4.5 | 4.5 | 5 |

TABLE 6B

| Color fastness of spun fiber | | | | | | |
|---|---|---|---|---|---|---|
| | color stay | | | | | |
| Spun fiber Samples | color change | cotton | polyamide | polyester | acrylic | wool |
| Indanthren Br Green | 5 | 4.5 | 4.5 | 4.5 | 4.5 | 4.5 |
| Indanthren Red | 5 | 4.5 | 4.5 | 4.5 | 4.5 | 5 |
| Levafix Blue E-GRN | 5 | 5 | 5 | 5 | 5 | 4.5 |
| Levafix Br Red | 5 | 5 | 5 | 5 | 5 | 5 |
| Remazol Black B 133% | 5 | 4.5 | 5 | 5 | 5 | 5 |

As can be seen from the data in the tables, the color of the five dyed fabrics has not changed.

For the color stay, the Levafix Blue E-GRN fabric has no change. The biggest change is the Indanthren Br Green fabric; the color faded slightly in cotton, polyamide and acrylic levels. As for Table 6, the color change of the dyed fibers is relatively large, especially the Remazol Black B 133% fiber, with a rating of 1, indicating that it has changed from black to another color(red). The color of the Levafix Br Red fiber in the color stay is unchanged. The color change of the Indanthren Br Green fiber is relatively the largest, where there is a color change at each level with a 4.5 value.

Figure 6A:
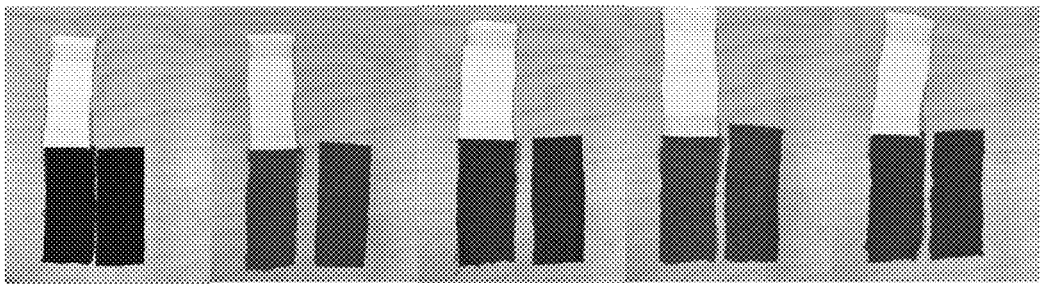
FIG. 6A is a photograph showing the dyed fabric samples (before and after washing)
Figure 6B:
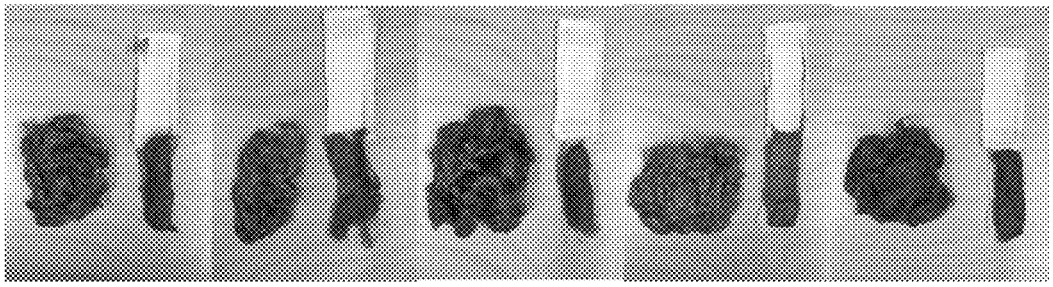
FIG. 6B is a photograph showing the dyed spun fibers (before and after washing)

The photos in FIG. 6 show the dyed fabric and the spun fibers before and after the treatments.

SEM of spun-fiber. The cross-sectional and surface structure of the spun fiber is characterized by the SEM in FIG. 7A to 7G.

Figure 7A:
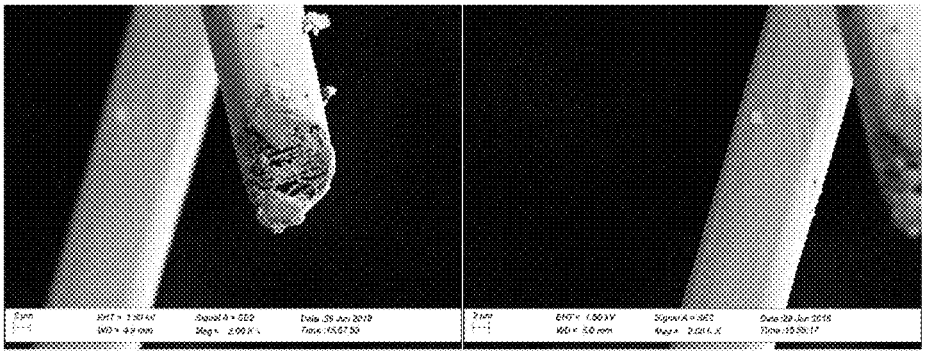
FIG. 7A is an SEM of spun fibers of a blank sample.
Figure 7B:
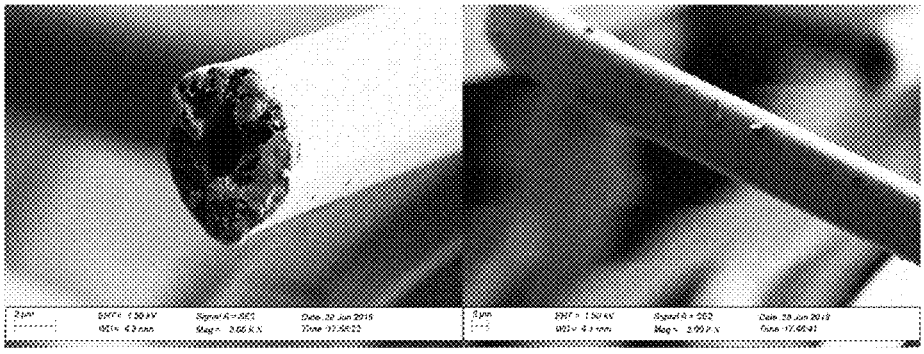
FIG. 7B is an SEM of spun fibers dyed with Indanthren Br Green.
Figure 7C:
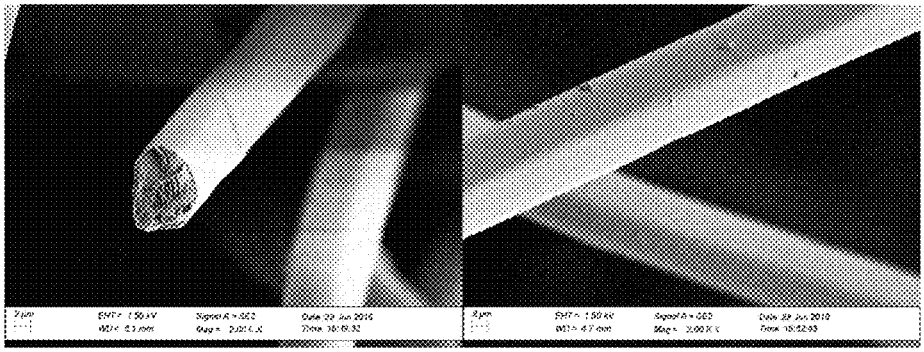
FIG. 7C is an SEM of spun fibers dyed with Indanthren Red.
Figure 7D:
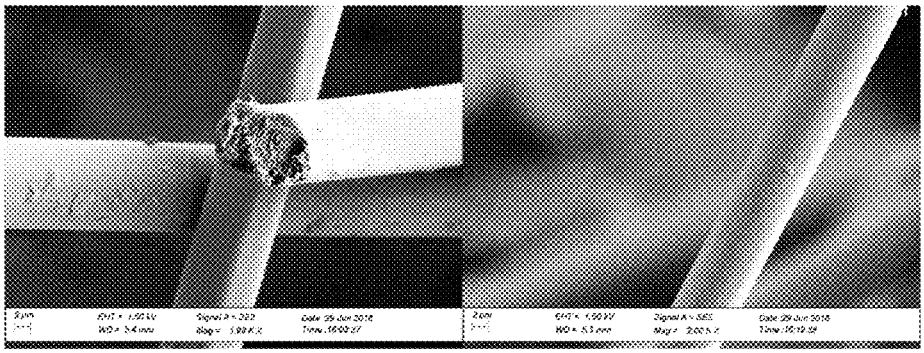
FIG. 7D is an SEM of spun fibers dyed with Levafix Blue E-GRN.
Figure 7E:
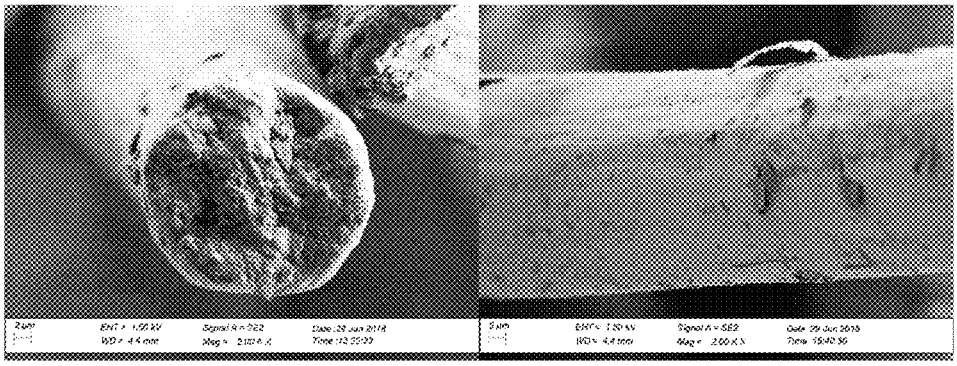
FIG. 7E is an SEM of spun fibers dyed with Levafix Brilliant Red.
Figure 7F:
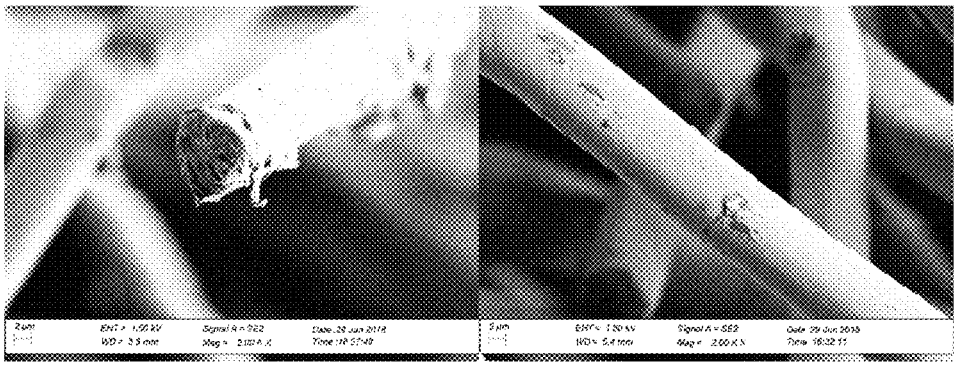
FIG. 7F is an SEM of spun fibers dyed with Remazol Black 133%.
Figure 7G:
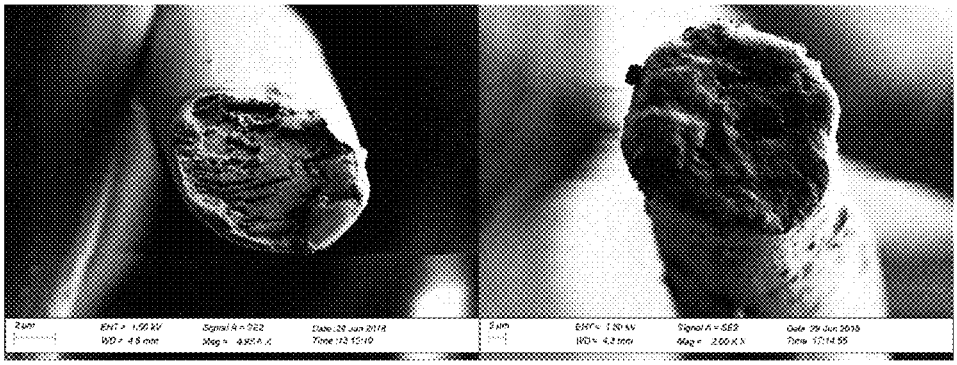
FIG. 7G is an SEM of spun fibers dyed with Remazol Brilliant Blue.

It can be seen from FIG. 7A that the blank sample without any dyes has a smooth fiber surface, a circular cross section and a uniform, dense fiber structure. Compared to the blank sample, the spun fibers dyed by the Indanthren Red FIG. 7C and Levafix Blue E-GRN dyes FIG. 7D have almost no changes, while the spun fibers of other dyes are worn on the fiber surface. The roughest of them is the Levafix Brilliant Red (FIG. 7E). The fiber spun from Levafix Brilliant Red is also the only one in this experiment that was not within the normal draw ratio for spinning. From the fiber structure of the cross section, only the spun fiber from the Indanthren Br Green (FIG. 7B) and Levafix Brilliant Red (FIG. 7E) dyes differed greatly from the Blank sample, while the other samples do not have any changes As the example shows, it is possible to translate dyes of different classes from waste fabric to new lyocell type fibers. This also partly indicates that the chemical structure of the dyes remain unchanged during the dry jet wet spinning. Five dyed white waste garment were successfully reycled by Inocell-F technology. By comparing the mechanical properties of the obtained six kinds of spun fiber (5 dyed fibers+1 blank sample), it can be concluded that the mechanical properties of the dyed fibers after spinning are on the order of those of the Blank sample. Some dyed fiber have even better mechanical strength than the blank sample.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

INDUSTRIAL APPLICABILITY

At least some embodiments of the present invention find industrial application in the manufacture and recycling of colored textiles and in the melt spinning of polyester.

CITATION LIST

Non Patent Literature

Sixta, H., A. Michud, L. Hauru, S. Asaadi, Y. Ma, A. W. T. King, I. Kilpeläinen, M. Hummel. *NPPRJ,* 30 (1), 43-57 (2015).

The invention claimed is:

1. A method of recycling of dyes used for dyeing of cellulosic fibers, said method comprising:

dissolving cellulosic fibers containing a dye into a superbase-based ionic liquid capable of dissolving the cellulosic fibers and the dye to form a spinning dope, wherein the superbase-based ionic liquid comprises [MTBDH][OAc], and using the dope to make colored fibers by spinning, the colored fibers having a color corresponding to a color of the cellulosic fibers.

2. The method according to claim 1, further comprising subjecting the spinning dope to dry jet-wet spinning to form textile fibers.

3. The method according to claim 1, wherein the cellulosic fibers comprise cotton fibers.

4. The method according to claim 1, wherein the spun colored fibers comprise a dye having a chemical structure of the azo, anthraquinone, phthalocyanine, methylazine, triazine or oxazine type.

5. The method according to claim 1, wherein the dye is a vat dye or a reactive dye, wherein the vat dye is an Indanthren dye, and wherein the reactive dye comprises Remazol, Levafix dye, or combinations thereof.

6. The method according to claim 1, wherein the dye is selected from the group consisting of Indanthren Br Green, Indanthren Red, Levafix Br Red E-4BA, Levafix Blue E-GRN, Remazol Black 133%, Remazol Br Blue and combinations thereof.

7. The method according to claim 1, wherein the cellulosic fibers comprise or are derived from pre-consumer textile waste, post-consumer textile waste, recycled cellulosic fibers, or cellulosic rich textile fibers.

8. The method according to claim 1, comprising the steps of:

providing colored recycled cellulose fibers or colored cellulose textile fibers, sorting the colored recycled cellulose fibers or the colored cellulose textile fibers according to color to form a feedstock having a preselected color, dissolving the feedstock in the superbase-based ionic liquid to form a spinning dope, and subjecting the spinning dope to dry jet-wet spinning to form the colored fibers having a color corresponding to a color of the cellulosic fibers.

9. The method according to claim 1, wherein the cellulosic fibers have a viscosity of about 450 ml/g.

10. The method according to claim 1, wherein the spun colored fibers are colored with a reactive dye, and wherein the reactive dye is selected from the group consisting of Levafix Br Red E-4BA, Levafix Blue E-GRN, Remazol Black 133%, Remazol Br Blue, and combinations thereof.

11. The method according to claim 1, wherein the spun colored fibers are colored with a reactive dye, and wherein the reactive dye is selected from the group consisting of Remazol Black B 133%, Remazol Br Blue, and Levafix Blue E-GRN gran.

12. The method according to claim 1, wherein the spun colored fibers have a dye concentration of from 0.1 to 5.0, by weight of the dry fibrous matter of the spun colored fibers.

13. The method according to claim 1, wherein the dye is a vat dye or a reactive dye.

* * * * *